United States Patent [19]

Manzoni

[11] Patent Number: 4,782,435

[45] Date of Patent: Nov. 1, 1988

[54] POSITION-WISE ADJUSTABLE LIGHTING FITTING

[76] Inventor: Luigi Manzoni, Via Dei Chiostri, 4 - 20121 Milano, Italy

[21] Appl. No.: 89,268

[22] Filed: Aug. 25, 1987

[30] Foreign Application Priority Data

Sep. 16, 1986 [IT] Italy ..... 23058[U]

[51] Int. Cl.[4] ..... F21M 3/18; F21S 1/02

[52] U.S. Cl. ..... 362/427; 362/430; 362/432; 16/348; 16/349; 248/291

[58] Field of Search ..... 362/427, 432, 418, 430; 248/291, 284; 16/239, 249, 319, 344, 348, 349

[56] References Cited

U.S. PATENT DOCUMENTS

| | | | |
|---|---|---|---|
| 1,466,859 | 9/1923 | Sutton | 348/291 |
| 2,519,163 | 8/1950 | Turner | 248/291 |
| 3,505,515 | 4/1970 | Adra | 248/291 |
| 3,850,401 | 11/1974 | Snediker | 248/291 |
| 4,196,821 | 4/1980 | Teti, Jr. | 248/291 |
| 4,466,664 | 8/1984 | Kondou | 248/291 |

*Primary Examiner*—James C. Yeung

*Attorney, Agent, or Firm*—Shlesinger, Fitzsimmons and Shlesinger

[57] ABSTRACT

Lighting fitting of the type comprising a support intended to be fixed to a wall or ceiling, or to a stem with base, and a body restrained to the said support in a position-wise adjustable manner through the intermediary of connection means, wherein the said connection means comprise a floating pin(17) on one side of the said support (11) and a tooth engagement system (18,19) on the opposite side, so that if the body (12) is acted on manually the mutual position of the teeth (18,19) of the said engagement means, and thus of the body with respect of the support, can be varied, the stable position of the said engagement being assured by weight of the body of the lighting fitting itself.

3 Claims, 3 Drawing Sheets

POSITION-WISE ADJUSTABLE LIGHTING FITTING

The present invention relates to a lighting fitting the body of which is restrained to a support in a position-wise adjustable manner through the intermediary of connection means of improved type.

Lighting fittings are known which are provided with knuckles permitting the adjustment of the body of the fitting with respect to the support, which can be restrained to the wall, ceiling or other support, for example a stem or column extending from a base.

Such knuckles for the most part comprise friction means which have to be released manually and relocked manually once the desired position of the lamphead has to be found.

Their construction is relatively simple and insecure, they are not particularly easy to use and, in addition, during use the friction means become no longer able to fulfil their locking function over time, especially in positions in which the weight on them of the lighting fitting is greatest.

The overall object of the present invention is to obviate the difficulties found in the known art by embodying a device by means of which the body of a lighting fitting is position-wise adjustable through the intermediary of means that can be relied on over time and which the user can handle readily and with full assurance that the lighting fitting will for no reasons shift from the preselected position, even if of a certain weight.

According to the invention the said object is attained by embodying a lighting fitting of the type comprising a support intended to be fixed to a wall or ceiling, or to a stem or standard with baseplate, and a body restrained to such support in a position-wise adjustable manner by connection means, wherein the said connection means comprise a floating pivot on one side of the said support and a toothed engagement means on the opposite side so that, by acting manually on the said body, the mutual position of the teeth of the said engagement means and thus of the body with respect to the support can be varied, the stable position of the said engagement means being assured by gravity by the weight of the body of the lighting fitting itself.

The said toothed engagement means preferably consists of a tooth incorporated in the body of the lighting fitting and of a toothed wheel in the form of a plurality of angularly spaced, tooth-shaped recesses incorporated in the support.

The structural and functional characteristics of the invention, and its advantages over the known art, will become more apparent from an examination of the following description, referred to the attached drawings which show an example of a lighting fitting embodied according to the innovative principles of the invention. In the drawings.

Figure 1:
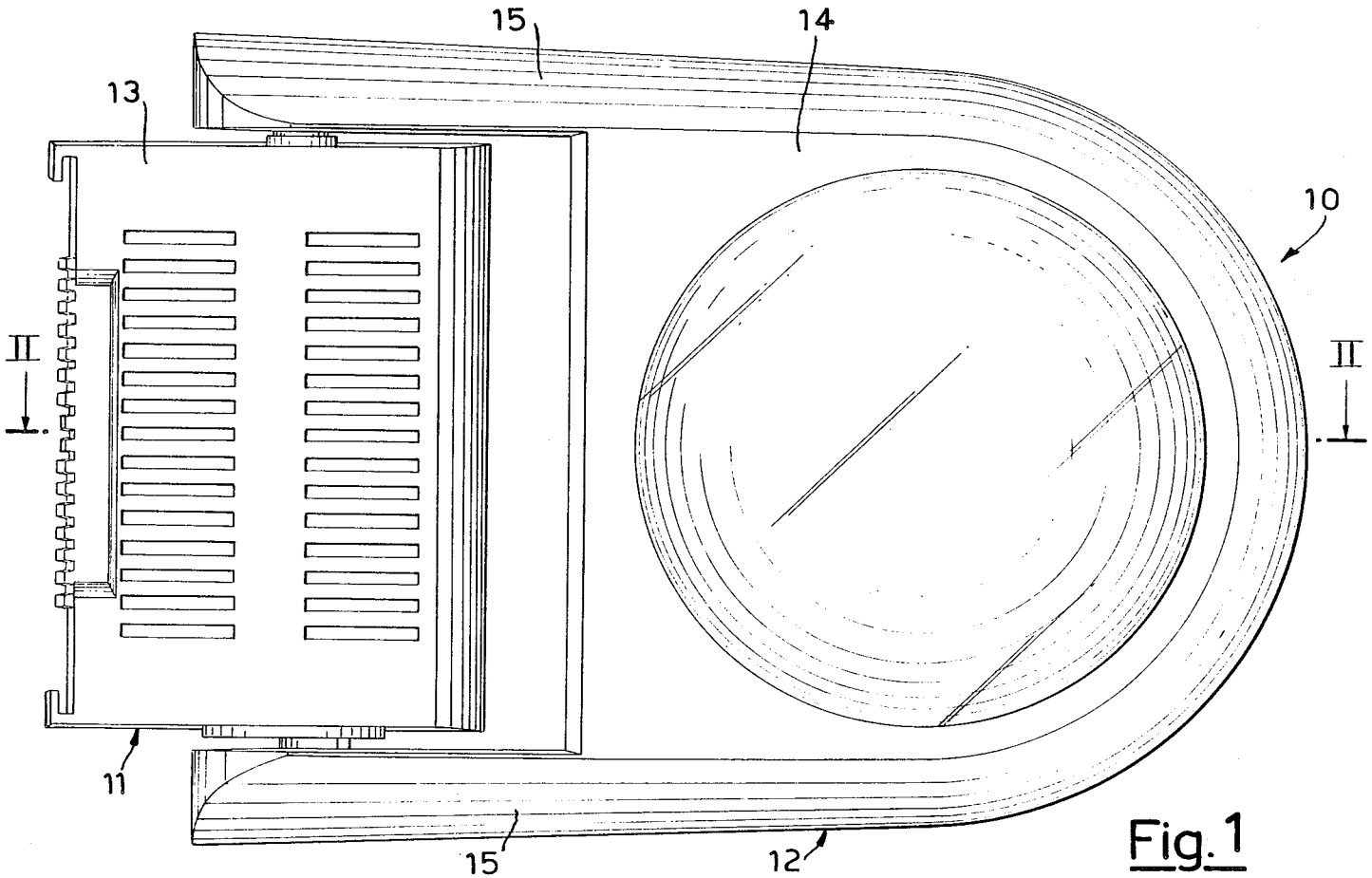
FIG. 1 is a bottom plan view of a lighting fitting embodied according to the invention, fixed to a ceiling.

With reference to the drawings, the lighting fitting in question is indicated overall by 10 and structurally consists of a support 11 and a body 12 interconnected in a position-wise adjustable manner through the intermediary of connection means that will be described hereinafter.

As the drawings clearly show, the support 11 consist of a grille-type box-shaped body 13, while the body 12 can comprise an arm 14 terminating a one end in a fork the prongs 15 of which take their place astride two opposed sides of the said support 11. The numeral 16 indicates an example of a diffuser element restrained to the lighting fitting 12. For the sake of simplicity of drawing and description, the light source is not here indicated.

In accordance with the invention the aforesaid connection means between support 11 and the light fitting body 12 comprise, in combination, a pin 17 and a tooth 18 and toothed wheel in the form of a plurality of tooth-shaped recesses 19.

The pin 17 projects solidly from an opening in one side 20 of the body 13 of the support 11, on which pin 17 there is floatingly pivoted, i.e. with a certain clearance, and restrained by a Seeger ring 21, a prong 15 of the fork of the lighting fitting 12. The clearance between pin 17 and the prong 15 permits the latter to be tilted slightly relative to the axis of pin 17 during adjustment of body 12.

The tooth 18, on the other hand, is solidly fixed on the other prong 15 of the fork of the lighting fitting 12 and is adapted releasably to engage in any one of a plurality of different positions in a toothed wheel, which comprises a plurality of angularly spaced, tooth-shaped recesses 19 that are formed in the periphery of a circular opening formed in the side 20 of the body 13 opposite to and in registry with the said pin 17.

The operation of the lighting fitting embodied according to the invention is evinced by the foregoing description with reference to the Figures and is, briefly, as follows:

It will firstly be apparent that the stable engagement in the desired position of the body of the lighting fitting 12 to the support 11 is assured by the combined action of the pin 17 and the tooth 18 engaged with one of the toothed wheel recesses 19; it should be noted that the stable engagement between tooth 18 and the recess 19 is assured by gravity by the weight of the lighting fitting 12 itself.

Figure 2:
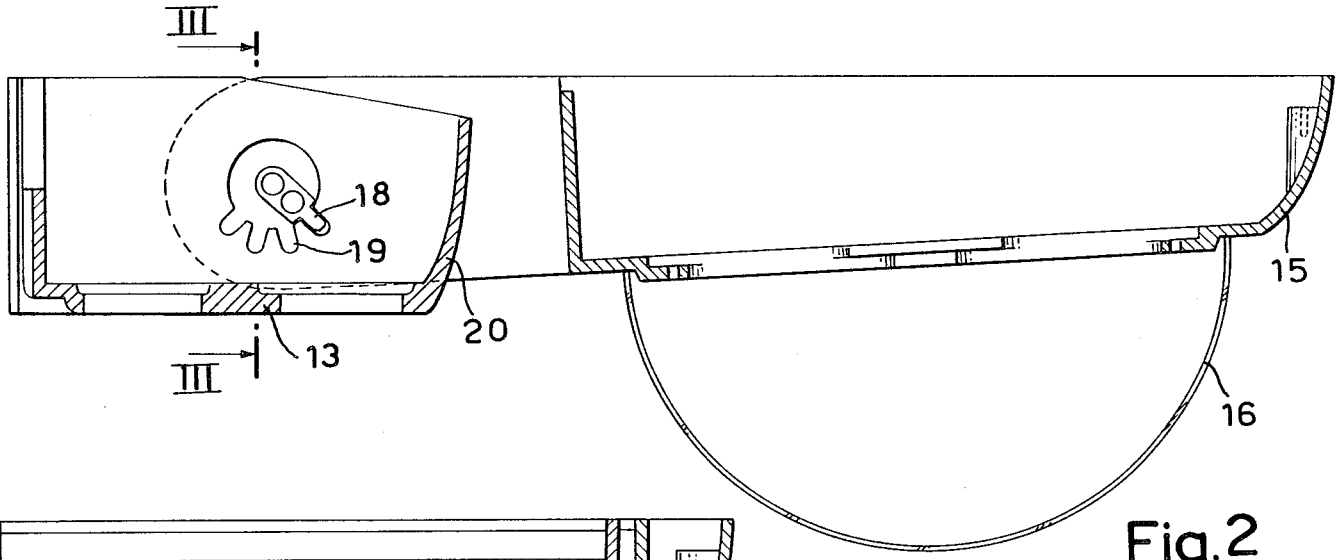
FIG. 2 is a section taken through the line II—II in FIG. 1.
Figure 3:
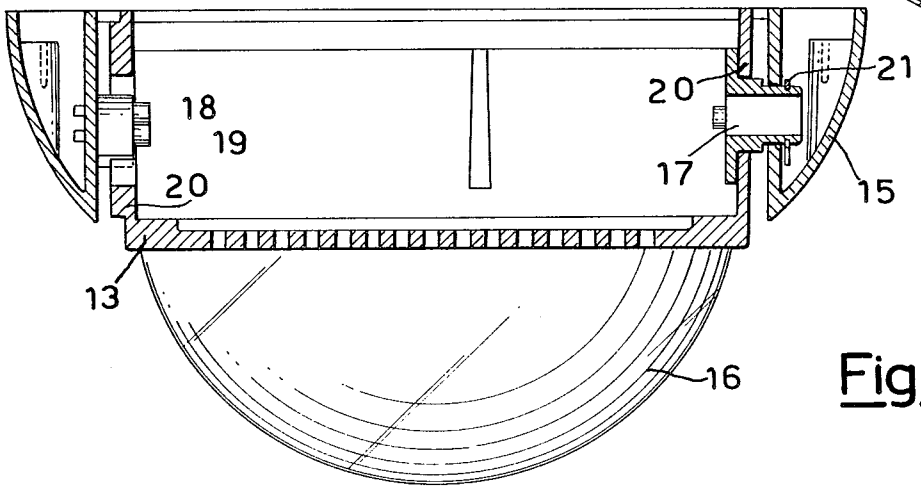
FIG. 3 is a section taken through the line III—III in FIG. 2.
Figure 4:
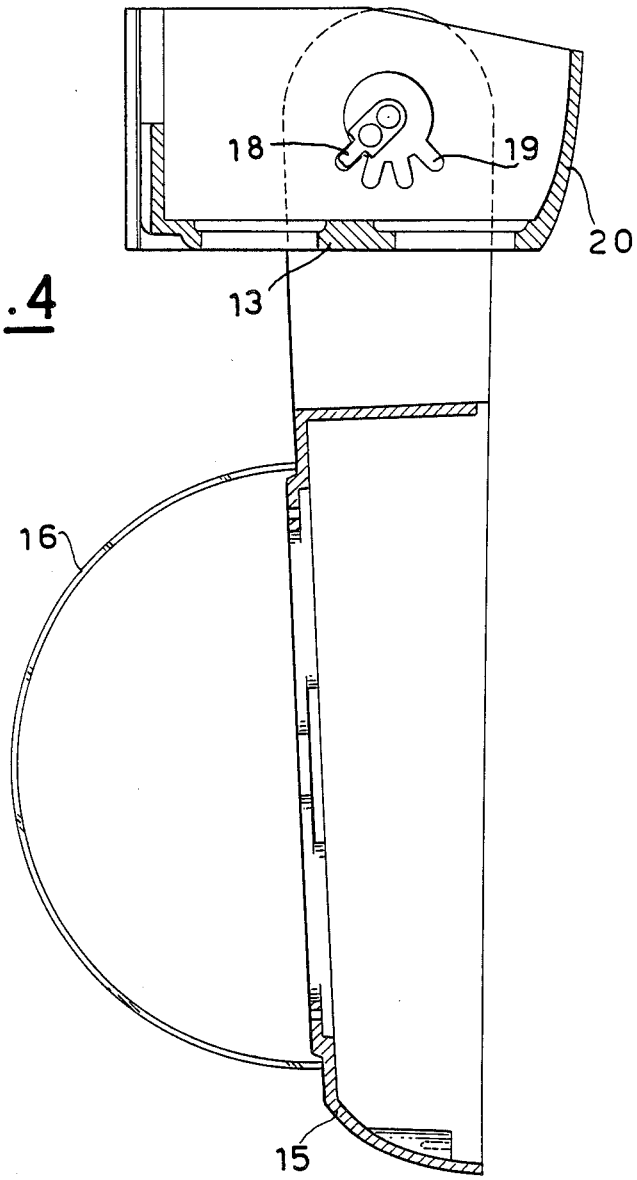
FIG. 4 is a view as in FIG. 2 but illustrating the lighting fitting in a different operating position.

When user wishes to vary the position of the lighting fitting 12, for example to move it from the horizontal position of FIG. 2 to the vertical position of FIG. 4, or to an intermediate position, all that is required is that the body 12 be tilted slightly relative to pin 17 in a radial plane through the center of the tooth 18, and in the direction of disengagement of the tooth 18 from the recess 19, after which the body 12 can be rotated to the desired position; at this point it will suffice simply to leave hold of the body 12 to cause engagement of the tooth 18 with the another recess 19—in a position different from the previous position—as a result of the weight of the light fitting body 12 itself.

There is in this way attained the overall object mentioned in the introductory part of the description, i.e. to embody a lighting fitting with a position-wise adjustable body in a highly straightforward and reliable manner—even if the movable body is a heavy one—through the intermediary of connection means between body and support. The tooth and recess (18, 19) heretofore described with respect to the Figures, as also their disposition, are exemplifying and not limiting, in that they can be replaced by equivalent means, for example pegs or the like.

I claim:

1. A lighting fitting of the type comprising a support disposed to be fixed to a wall or ceiling, a body having opposed sides, and connection means mounting said body on said support in a position-wise adjustable manner, said connection means comprising a floating pin connection on one side of the said support and a cooperating tooth and recess engagement system on the opposite side thereof supporting said body for angular adjustment with respect of the support, said connection means also supporting said body for limited tilting movement transversely of the axis of said pin selectively to disengage said tooth from said recess to effect angular adjustment of said body, and to reengage said tooth in another recess after angular adjustment of said body, said engagement of said tooth in said recess being assured by weight of the body of the lighting fitting itself.

2. A lighting fitting as described in claim 1, wherein the tooth engagement means comprises a tooth incorporated in said body and a plurality of toothed shaped recesses incorporated in the support.

3. A lighting fitting as described in claim 1, wherein said support comprises a box-shaped housing, and said body comprises an arm with one end in the form of a fork having spaced prongs which are connected to the opposed sides of said support by said connection means.

* * * * *